US007885582B2

(12) United States Patent
Okimura et al.

(10) Patent No.: US 7,885,582 B2
(45) Date of Patent: Feb. 8, 2011

(54) IMAGE FORMING APPARATUS HAVING DEVELOPING MATERIAL CARTRIDGES AND A SUPPLY DEVELOPING MATERIAL CONTAINER

(75) Inventors: Naomasa Okimura, Saitama (JP); Atsuna Saiki, Saitama (JP); Takeshi Okoshi, Ebina (JP); Kazuhiro Saito, Saitama (JP); Kiyoshi Sakoh, Saitama (JP); Hideyuki Ohtani, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 829 days.

(21) Appl. No.: 11/694,216

(22) Filed: Mar. 30, 2007

(65) Prior Publication Data

US 2008/0080900 A1 Apr. 3, 2008

(30) Foreign Application Priority Data

Oct. 2, 2006 (JP) ..... 2006-270469

(51) Int. Cl.
*G03G 15/08* (2006.01)

(52) U.S. Cl. ..... 399/258; 399/119; 399/120; 399/263; 399/259; 399/360

(58) Field of Classification Search ..... 399/119, 399/120, 258, 263, 259, 360
See application file for complete search history.

(56) References Cited

U.S. PATENT DOCUMENTS 6,226,490 B1 5/2001 Fujita et al.
6,366,755 B1 * 4/2002 Takashima ..... 399/254
2006/0216086 A1 9/2006 Yuasa et al.

FOREIGN PATENT DOCUMENTS

| | | | |
|---|---|---|---|
| CN | 1837977 A | | 9/2006 |
| JP | 02-081067 A | | 3/1990 |
| JP | 07-072728 A | | 3/1995 |
| JP | 09212055 A | * | 8/1997 |
| JP | 2003-302822 A | | 10/2003 |
| JP | 2005-189523 A | | 7/2005 |

OTHER PUBLICATIONS

English Abstract of JP09212055 to Ishii et al.*

* cited by examiner

*Primary Examiner*—Ryan D Walsh
(74) *Attorney, Agent, or Firm*—Sughrue Mion, PLLC

(57) ABSTRACT

An image forming apparatus includes: an image holder; a developing device that develops a latent image formed on the image holder with developing material; a developing material cartridge that has a supply developing material container to contain developing material; and a developing material conveyance unit, having a connection portion connected to the developing device, that conveys the developing material from the supply developing material container to the developing device. The developing material cartridge is provided in a direction approximately orthogonal to the developing device. At least a part of the connection portion is provided within a heightwise directional width of the developing material cartridge.

8 Claims, 12 Drawing Sheets

IMAGE FORMING APPARATUS HAVING DEVELOPING MATERIAL CARTRIDGES AND A SUPPLY DEVELOPING MATERIAL CONTAINER

CROSS-REFERENCE TO RELATED APPLICATIONS

This application is based on and claims priority under 35 USC 119 from Japanese Patent Application No. 2006-270469 filed Oct. 2, 2006.

BACKGROUND

The present invention relates to an image forming apparatus such as a printer, a facsimile machine and a copier.

TECHNICAL FIELD

As this type of image forming apparatus, a xerography apparatus is known. In this apparatus, an image holder is uniformly charged, a latent image is formed by an exposure unit, the latent image is visualized with toner by a developing device, the toner image is transferred onto a sheet by a transfer device, and the toner is fixed to the sheet by a fixing device.

SUMMARY

According to an aspect of the invention, there is provided an image forming apparatus including: an image holder; a developing device that develops a latent image formed on the image holder with developing material; a developing material cartridge that has a supply developing material container to contain developing material; and a developing material conveyance unit, having a connection portion connected to the developing device, that conveys the developing material from the supply developing material container to the developing device. The developing material cartridge is provided in a direction approximately orthogonal to the developing device, and at least a part of the connection portion is provided within a heightwise directional width of the developing material cartridge.

BRIEF DESCRIPTION OF THE DRAWINGS

Exemplary embodiments of the present invention will be described in detail based on the following figures, wherein.

DETAILED DESCRIPTION

First, a first exemplary embodiment of the present invention will be described based on the drawings.

Figure 1:
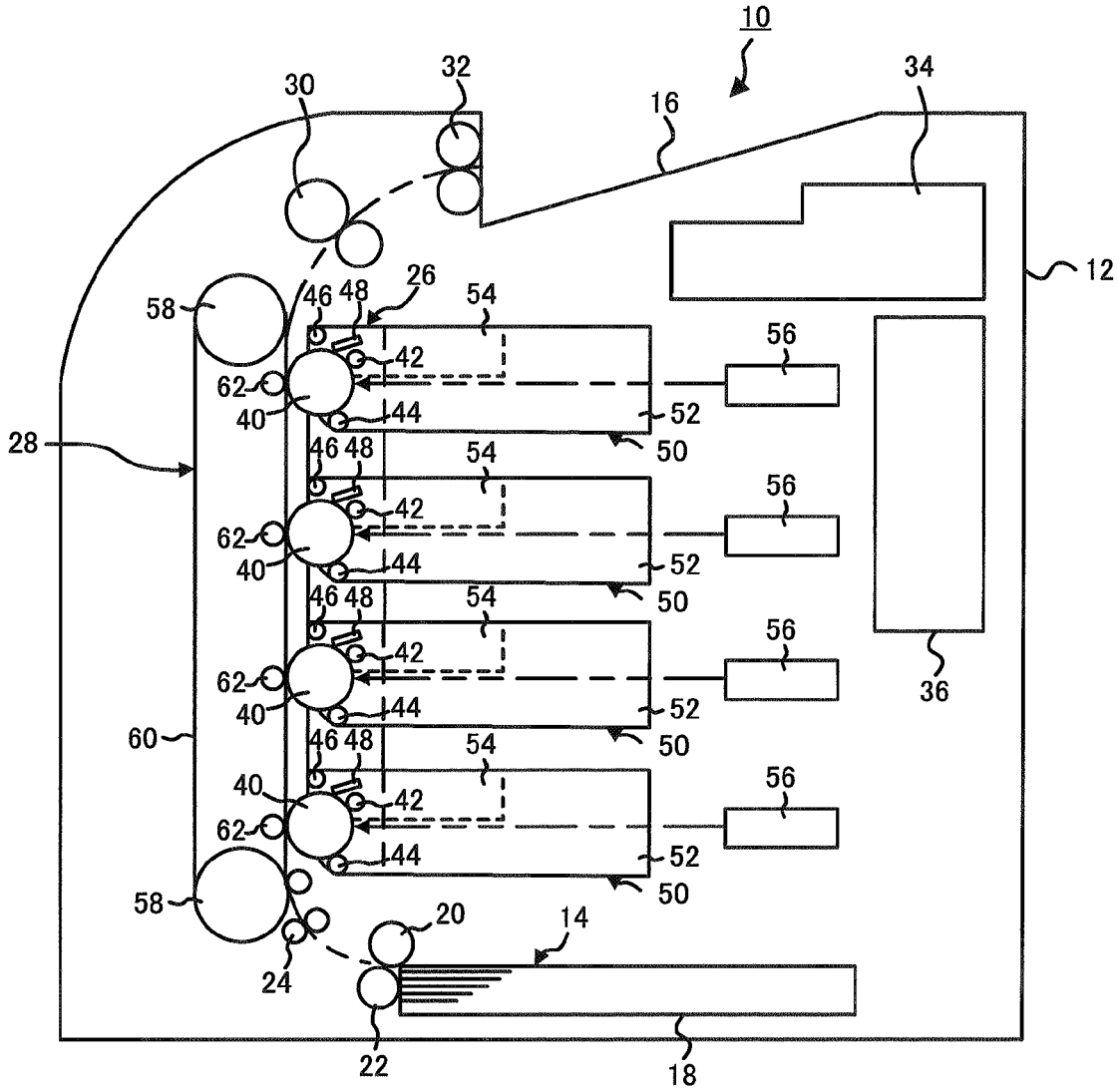
FIG. 1 is a cross-sectional view showing an image forming apparatus 10 according to a first exemplary embodiment of the present invention.

FIG. 1 shows an image forming apparatus 10 according to the first exemplary embodiment of the present invention.

As shown in FIG. 1, the image forming apparatus 10 has an image forming apparatus main body 12. A paper feeder 14 is provided in a lower position of the image forming apparatus main body 12, and a paper discharge unit 16 is formed in an upper part of the image forming apparatus main body 12.

The paper feeder 14 has a paper tray 18 on which a large number of sheets are stacked. The paper tray 18 is provided with a feed roller 20 at its upper end and a retard roller 22 opposite to the feed roller 20. A top sheet on the paper tray 18 is picked up with the feed roller 20 and fed and conveyed by a cooperative work between the feed roller 20 and the retard roller 22.

The sheet conveyed from the paper tray 18 is temporarily stopped with registration rollers 24, passed between an image holder unit 26 to be described later and a transfer unit 28 and through a fixing device 30, at predetermined timing, and discharged with a paper discharge roller 32 to the paper discharge unit 16.

The image forming apparatus main body 12 includes the image holder unit 26, the transfer unit 28, a power source unit 34 and a controller 36. In the image holder unit 26, four image holders 40, for example, to hold an image to be transferred to a conveyance belt 60 or a sheet conveyed with the conveyance belt 60, are rotatably supported. A charging device 42 as a charger having a charging roller to uniformly charge the image holder 40, a developing device 44 to develop a latent image formed on the image holder 40 with developing material (toner), a diselectrifying device 46 to diselectrify the image holder 40 after transfer, and a cleaning device 48 as a developing material removing unit to remove developing material remaining on the image holder 40 after transfer, are provided around each of the image holders 40. The image holder unit 26 is attachable/removable to/from the image forming apparatus main body 12.

The four developing material cartridges 50 are attached to the side of the rear side of the image holder unit 26. The developing material cartridges 50, corresponding to magenta, yellow, cyan and black colors, respectively include a supply developing material container 52 and collected developing material container 54 integrated with each other. The supply developing material container 52 contains developing material of corresponding color to be supplied to the developing device 44, and the collected developing material container 54 contains developing material of a corresponding color removed with the cleaning device 48 from the image holder 40.

A light writer 56 having a laser exposure device is provided in a position corresponding to each image holder 40 on the rear side of the image holder unit 26. The light writer 56 emits laser to the uniformly charged image holder 40 thereby forms a latent image.

The transfer unit 28 is provided in a vertical direction, in a position opposite to the image holder unit 26, on the front side of the image holder unit 26. In the transfer unit 28, the conveyance belt 60 is put around two support rollers 58 provided in the vertical direction. The conveyance belt 60 conveys an image or a sheet. Further, a transfer roller 62 is provided in a position opposite to each image holder 40, with the conveyance belt 60 therebetween.

Figure 2:
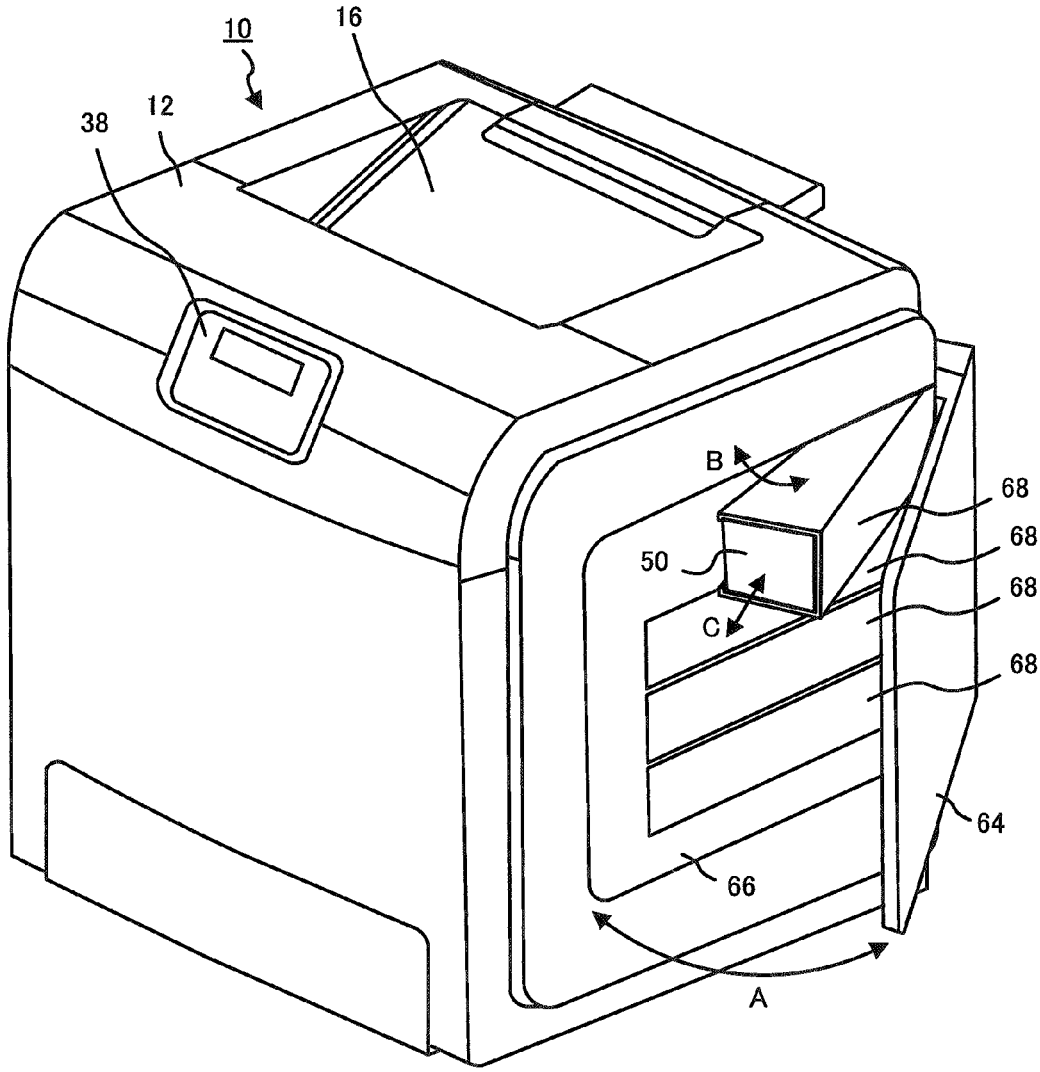
FIG. 2 is a perspective view showing the image forming apparatus 10 according to the first exemplary embodiment of the present invention.

FIG. 2 is a perspective view showing the image forming apparatus 10 according to the exemplary embodiment of the present invention.

As shown in FIG. 2, an open-close cover 64 is provided on one side surface of the image forming apparatus main body 12. The open-close cover 64 has a rotation support (not shown) at its end. As indicated with an arrow A in FIG. 2, the open-close cover 64 is rotatably opened/closed about the rotation support. In the image forming apparatus main body 12, a developing material supply controller 66 (dispenser) is provided on the side where the open-close cover 64 is provided. The developing material supply controller 66 has the developing material cartridge holders 68 holding e.g. four developing material cartridges 50. The developing material supply controller 66 supplies the developing material, contained in the supply developing material containers 52 in the developing material cartridges 50, held with the developing material cartridge holders 68 and attached to the image forming apparatus main body 12, to the image holder unit 26.

The developing material cartridge holders 68 respectively have a rotation support (not shown) at one end. As indicated with an arrow B in FIG. 2, the developing material cartridge holders 68 move about the rotation support. Accordingly, when the open-close cover 64 is opened and the developing material cartridge holder 68 is moved away from the image forming apparatus main body 12, the developing material cartridge 50 is removed from the image forming apparatus main body 12. Then as indicated with an arrow C in FIG. 2, the developing material cartridge 50 may be taken out from the developing material cartridge holder 68. On the other hand, in a status where the developing material cartridge holder 68 is away from the image forming apparatus main body 12, when the developing material cartridge 50 is inserted into the developing material cartridge holder 68 and the developing material cartridge holder 68 is moved toward the image forming apparatus main body 12, the developing material cartridge 50 is attached to the image forming apparatus main body 12.

Further, an operation panel 38 is provided on the side-surface front side of the image forming apparatus main body 12. The operation panel 38, having a display to display predetermined contents under the control of the controller 36 and buttons (not shown) to accept a user's operation, outputs the accepted operation via the button to the controller 36.

Figure 3:
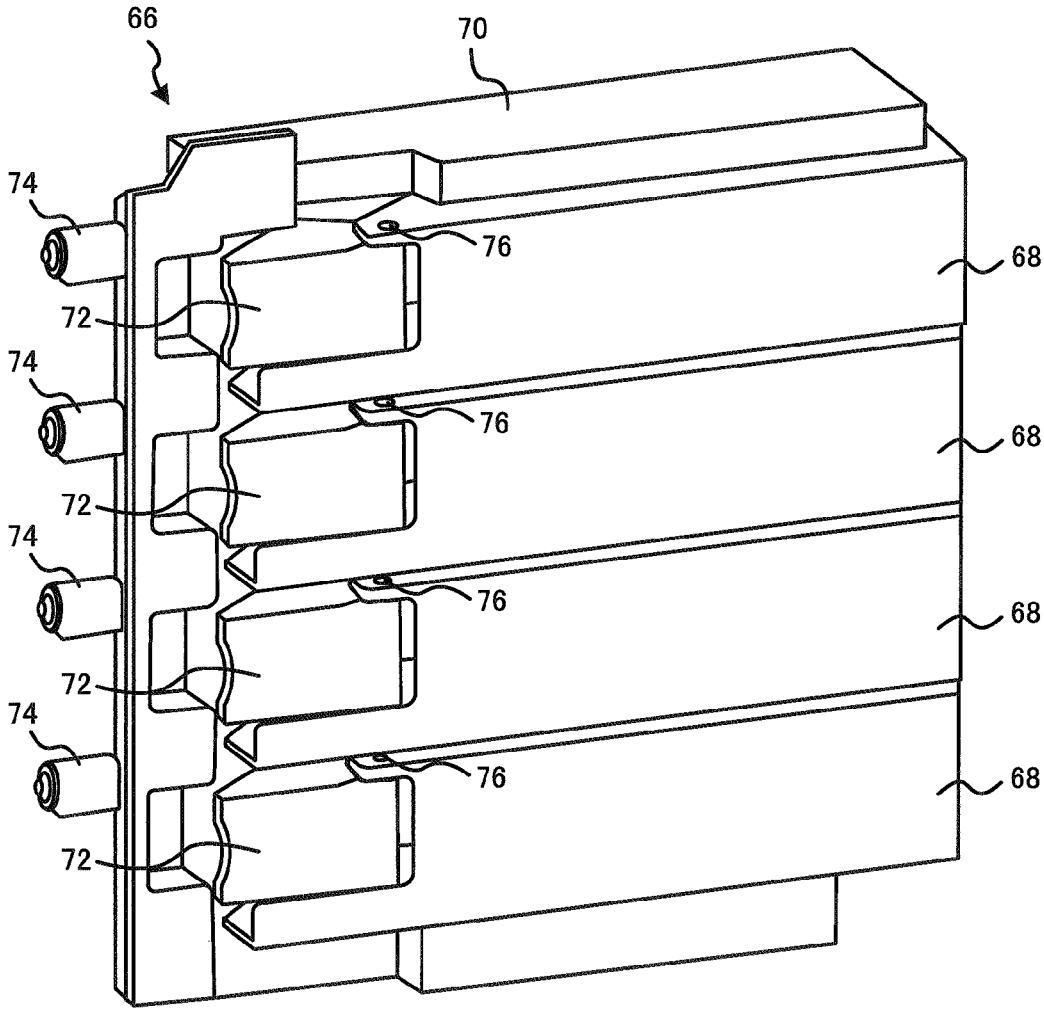
FIG. 3 is a perspective view showing a developing material supply controller 66 of the image forming apparatus 10 according to the first exemplary embodiment of the present invention.

FIG. 3 shows the details of the developing material supply controller 66 of the image forming apparatus 10 according to the exemplary embodiment of the present invention.

As shown in FIG. 3, the developing material supply controller 66 has the developing material cartridge holders 68, a developing material supply controller main body 70, a lever 72, a rotation support 76 for rotation of the lever 72 and a first connection portion 74 connected to the image holder unit 26. The developing material supply controller 66 supplies a predetermined amount of developing material contained in the supply developing material container 52 of the developing material cartridge 50 to the image holder unit 26 under the control of the controller 36.

The lever 72 moves the position of the developing material cartridge 50 held in the developing material cartridge holder 68. More particularly, in a status where the developing material cartridge 50 is held in the developing material cartridge holder 68, when the lever 72 is turned about the rotation support 76, the developing material cartridge 50 is moved along a lengthwise direction of the developing material cartridge holder 68.

FIGS. 4A to 4E show a positional relationship between the developing material cartridge holder 68 and the developing material cartridge 50 held in the developing material cartridge holder 68 when the lever 72 is turned.

Figure 4A:
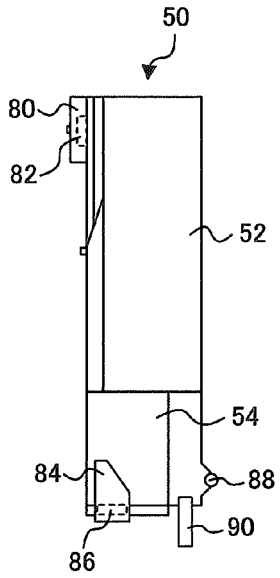
FIGS. 4A to 4E are show a positional relationship between a developing material cartridge holder 68 and a developing material cartridge 50 held in the developing material cartridge holder 68 when a lever 72 is turned.

FIG. 4A is a top view of the developing material cartridge 50. A s shown in FIG. 4A, the developing material cartridge 50 has the supply developing material container 52, the collected developing material container 54, a supply orifice 82 to supply developing material from the supply developing material container 52 to the developing material supply controller 66, a supply orifice shutter member 80 to open/close the supply orifice 82, a collection orifice 86 to collect developing material collected from the image holder 40 into the collected developing material container 54 from the developing material supply controller 66, a collect orifice shutter member 84 to open/close the collection orifice 86, a convex member 88 engaged with the lever 72, and an eject member 90 held by an operator upon ejection of the developing material cartridge 50 from the developing material cartridge holder 68.

FIGS. 4B to 4E show the positional relationship when the developing material cartridge 50 held in the developing material cartridge holder 68 is attached to the developing material supply controller main body 70.

Figure 4B:
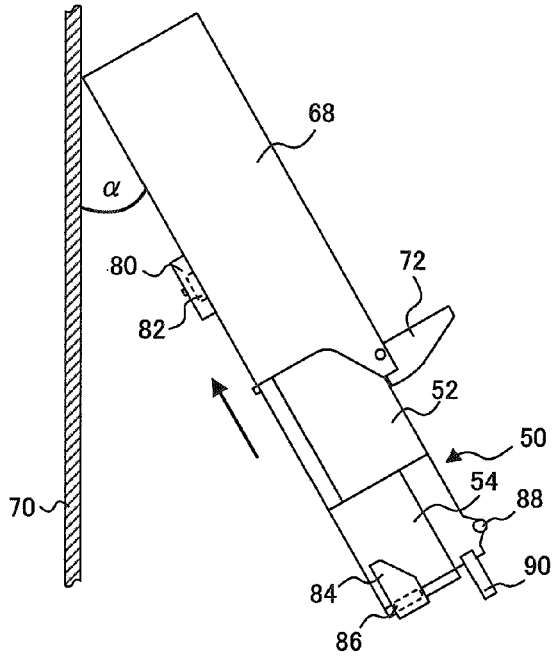

As shown in FIG. 4B, the developing material cartridge 50 is inserted into the developing material cartridge holder 68 in a direction indicated with an arrow in FIG. 4B in a status where the developing material cartridge holder 68 is moved away from the developing material supply controller 66 by an angle $\alpha$.

Figure 4C:
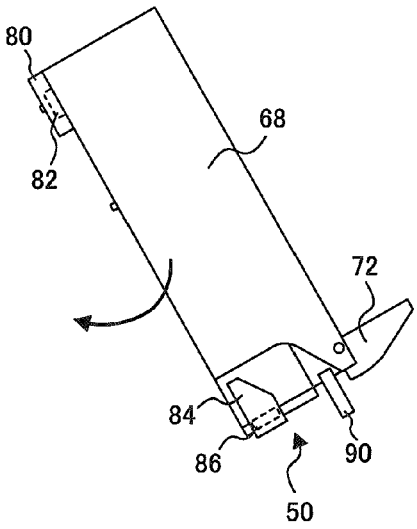

As shown in FIG. 4C, when the developing material cartridge 50 is inserted into the developing material cartridge holder 68, the developing material cartridge holder 68 is moved in a direction in which the angle a is decreased, to a position approximately parallel to the developing material supply controller 66.

Figure 4D:
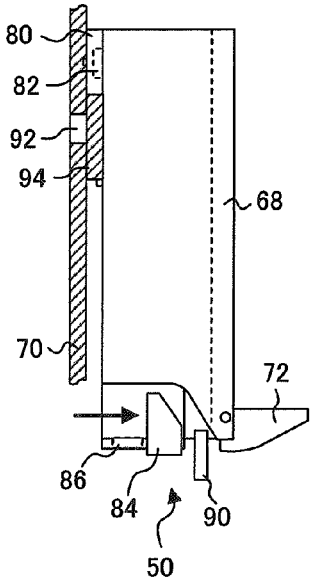

As shown in FIG. 4D, when the developing material cartridge holder 68 is moved to a position approximately parallel to the developing material supply controller main body 70, a collection orifice shutter member 84 comes into contact with a convex member (not shown) of the developing material supply controller main body 70 and is moved in a direction indicated with an arrow in FIG. 4D, thereby the collection orifice 86 is opened.

Figure 4E:
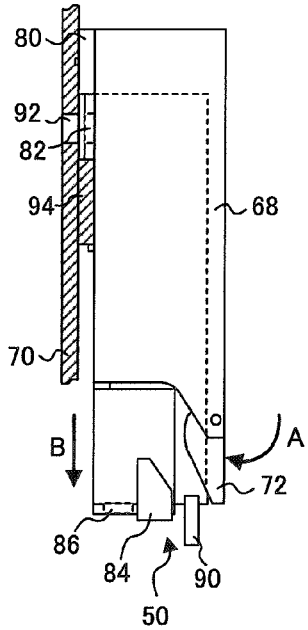

As shown in FIG. 4E, when the lever 72 is turned in a direction indicated with an arrow A in FIG. 4E, the lever 72 is engaged with the convex member 88 of the developing material cartridge 50, and operated as e.g. a groove cam, thereby the developing material cartridge 50 is moved in a direction indicated with an arrow B in FIG. 4E. The supply orifice shutter member 80, in contact with the developing material supply controller main body 70, remains in the initial position, and the supply orifice 82 is opened. Further, as described later, in the developing material supply controller main body 70, in accordance with movement of the developing material cartridge 50 with an opening 92 and an opening shutter member 94 to open/close the opening 92, the opening shutter member 94 is moved in a direction indicated with an arrow B in FIG. 4E. Accordingly, the opening 92 is opened. The supply developing material container 52 of the developing material cartridge 50 is in communication with the developing material supply controller 66 via the supply orifice 82 and the opening 92.

Further, in accordance with the movement of the developing material cartridge 50, a second connection portion 112 of the image holder unit 26 to be described later is inserted into the collection orifice 86. The collected developing material container 54 of the developing material cartridge 50 is in communication with the image holder unit 26 via the collection orifice 86.

Figure 5:
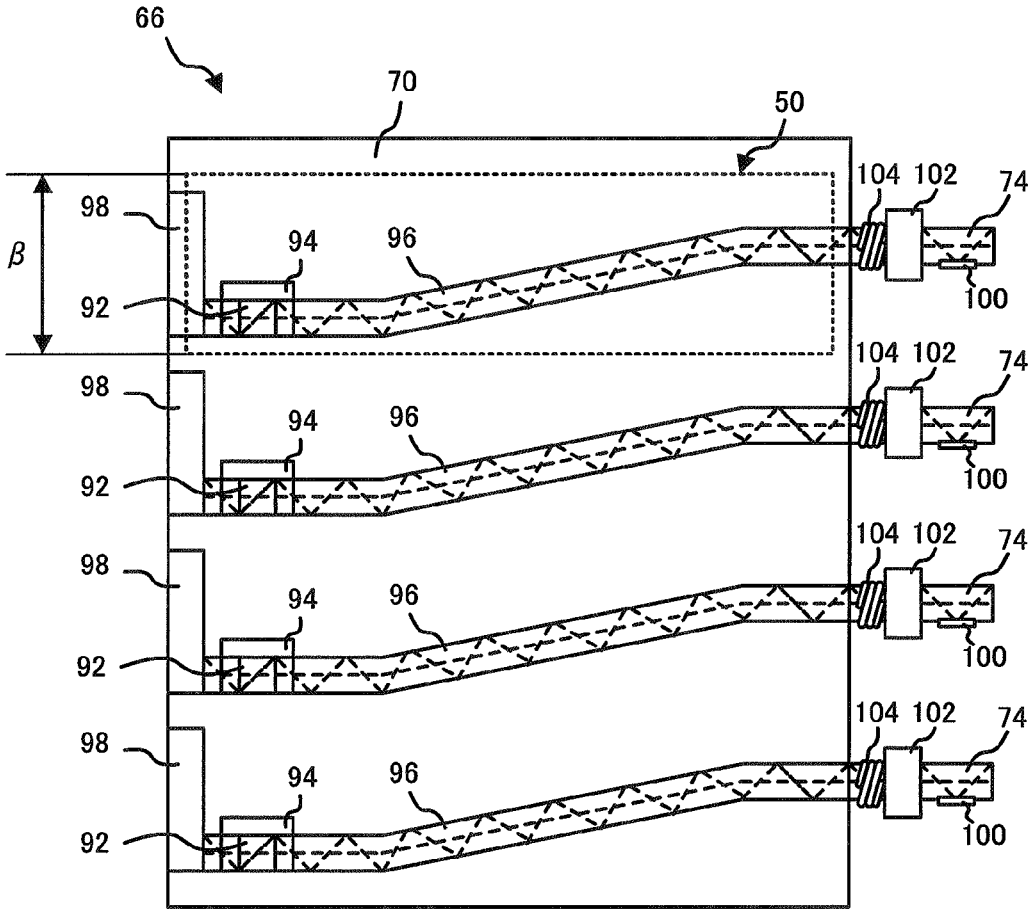
FIG. 5 is a side view showing the developing material supply controller 66 of the image forming apparatus 10 according to the first exemplary embodiment of the present invention.

FIG. 5 is a side view showing the developing material supply controller 66 of the image forming apparatus 10 according to the exemplary embodiment of the present invention.

As shown in FIG. 5, the developing material supply controller 66 has the opening 92 to supply developing material from the supply developing material container 52 of the developing material cartridge 50, the opening shutter member 94, a supply developing material conveyance unit 96 to convey the developing material supplied via the opening 92 to the image holder unit 26, a motor 98 to operate the supply developing material conveyance unit 96, the first connection portion 74 provided at one end of the supply developing material conveyance unit 96, an opening 100 provided in a lower part of the first connection portion 74, an opening shutter member 102 to open/close the opening 100, and an elastic member 104 such as a spring to push the shutter member 102 in the direction of the opening 100. Note that in FIG. 5, the developing material cartridge 50 attached to the developing material supply controller 66 is indicated with a broken line.

The supply developing material conveyance unit 96, approximately parallel to the lengthwise direction of the developing material cartridge 50, rises from one end toward the first connection portion 74. Accordingly, the first connection portion 74 is connected to the supply developing material container 52 of the developing material cartridge 50 via the supply developing material conveyance unit 96. Assuming that the width of the developing material cartridge 50 in its heightwise direction is β, at least a part of the first connection portion 74 is within the heightwise directional width (β) of the developing material cartridge 50. In the present exemplary embodiment, the opening 100 is within the heightwise directional width (β) of the developing material cartridge 50. The opening 100 is closed with the shutter member 102. When the first connection portion 74 is connected to the image holder unit 26, the shutter member 102 is moved with the image holder unit 26 to a position shown in FIG. 5, thereby the opening 100 is opened.

Figure 6:
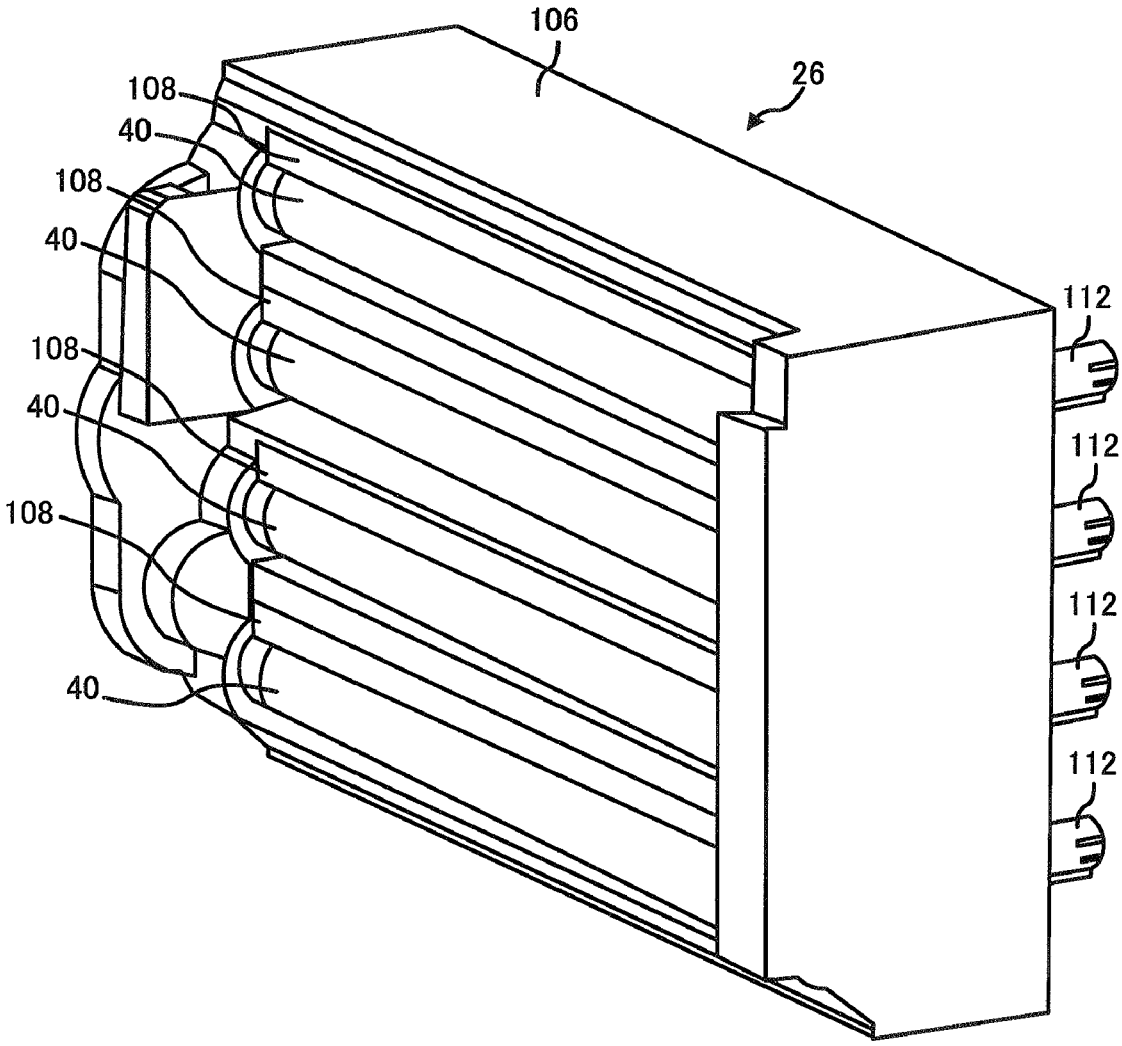
FIG. 6 is a perspective view showing an image holder unit 26 of the of the image forming apparatus 10 according to the first exemplary embodiment of the present invention viewed from a front side.
Figure 7:
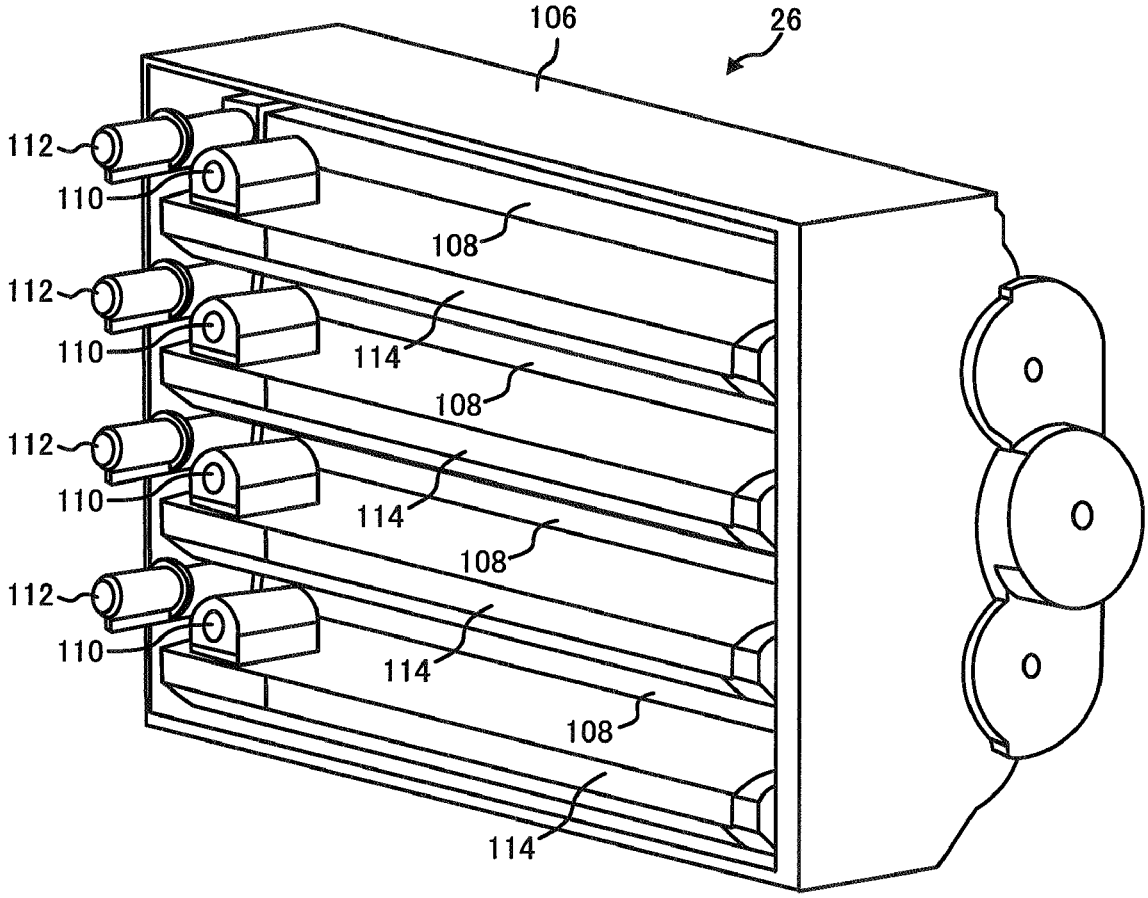
FIG. 7 is a perspective view showing the image holder unit 26 of the image forming apparatus 10 according to the first exemplary embodiment of the present invention viewed from a rear side.

FIGS. 6 and 7 are perspective views showing the image holder unit 26 of the image forming apparatus 10 according to the exemplary embodiment of the present invention. FIG. 6 shows the image holder unit 26 viewed from a front side. FIG. 7 shows the image holder unit 26 viewed from a rear side.

As shown in FIGS. 6 and 7, the image holder unit 26 has an image holder unit main body 106, an insertion portion 110 into which the first connection portion 74 of the developing material supply controller 66 is inserted, a developing unit 114 to develop a latent image formed on the image holder 40 with developing material supplied via the insertion portion 110, a collected developing material conveyance unit 108 to convey developing material collected from the image holder 40 to the collected developing material container 54 of the developing material cartridge 50, and a second connection portion 112 connected to the collected developing material container 54 of the developing material cartridge 50. Note that at least a part of the second connection portion 112 is within the heightwise directional width (β) of the developing material cartridge 50 shown in FIG. 5. In the present exemplary embodiment, an opening 140 to be described later is within the heightwise directional width (β) of the developing material cartridge 50 shown in FIG. 5.

Figure 8:
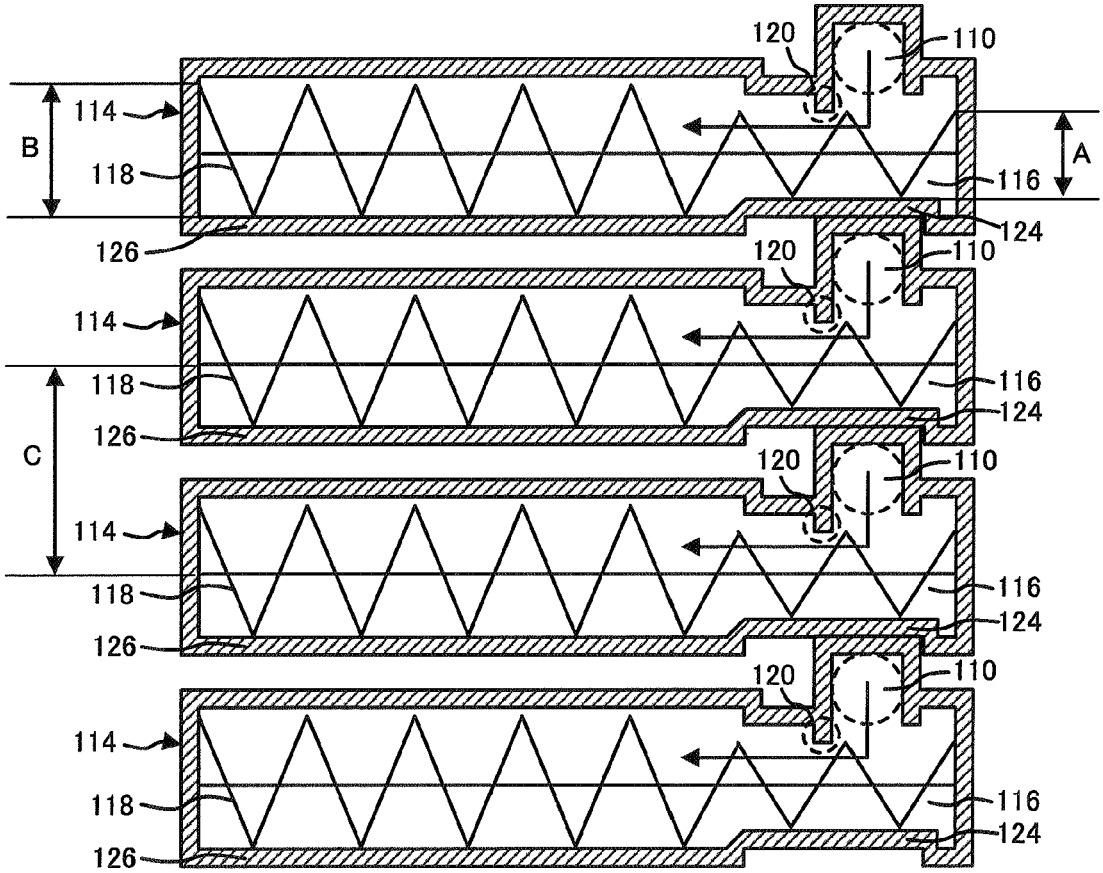
FIG. 8 is a cross-sectional view showing a developing unit 114 of the image forming apparatus 10 according to the first exemplary embodiment of the present invention viewed from a front side.

FIG. 8 is a cross-sectional view showing the developing unit 114 of the image forming apparatus 10 according to the exemplary embodiment of the present invention viewed from a front side.

As shown in FIG. 8, each developing unit 114 of the image forming apparatus 10 according to the exemplary embodiment of the present invention is provided with a conveyance path 116 to convey developing material supplied from the developing material supply controller 66. The conveyance path 116 has a bottom surface including a first bottom surface 124 and a second bottom surface 126 lower than the first bottom surface 124. Accordingly, in the conveyance path 116, the bottom surface has a step portion which becomes lower along a developing material conveyance direction. The conveyance path 116 has a cross section which becomes larger along the developing material conveyance direction. Note that an arrow in FIG. 8 indicates the developing material conveyance direction.

The insertion portion 110 is provided in an upper part of the conveyance path 116. At least a part of the insertion portion 110 is formed in a position lower than an upper inner wall of the conveyance path 116. Further, the conveyance path 116 has a projection member 120 having a projection upper surface. The projection 120 member is integrally formed with a lower end of the inner wall forming the insertion portion 110, and projected from the inner wall of the upper surface of the conveyance path 116.

The conveyance path 116 is provided with a supply developing material conveyance member 118 to convey developing material supplied from the developing material supply controller 66. A part of the supply developing material conveyance member 118 close to the insertion portion 110 is thinner along the developing material conveyance direction. More particularly, as indicated with width A and width B in FIG. 8, a portion of the supply developing material conveyance member 118 corresponding to the first bottom surface 124 is thinner than a portion correction to the second bottom surface 126. Accordingly, the supply developing material conveyance member 118 has a diameter which becomes larger along the developing material conveyance direction.

The plural developing units 114 are stacked in a gravitational direction. The upper surface of the insertion portion 110 is in contact with an outer wall corresponding to the fist bottom surface 124, and at least a part of the insertion portion 110 is positioned lower than the upper surface of the developing unit 114, and the first bottom surface 124 is positioned higher than the second bottom surface 126. Accordingly, the interval between the developing units 114 (interval indicated with an arrow C in FIG. 8) is shorter than a case without the present arrangement.

Figure 9A:
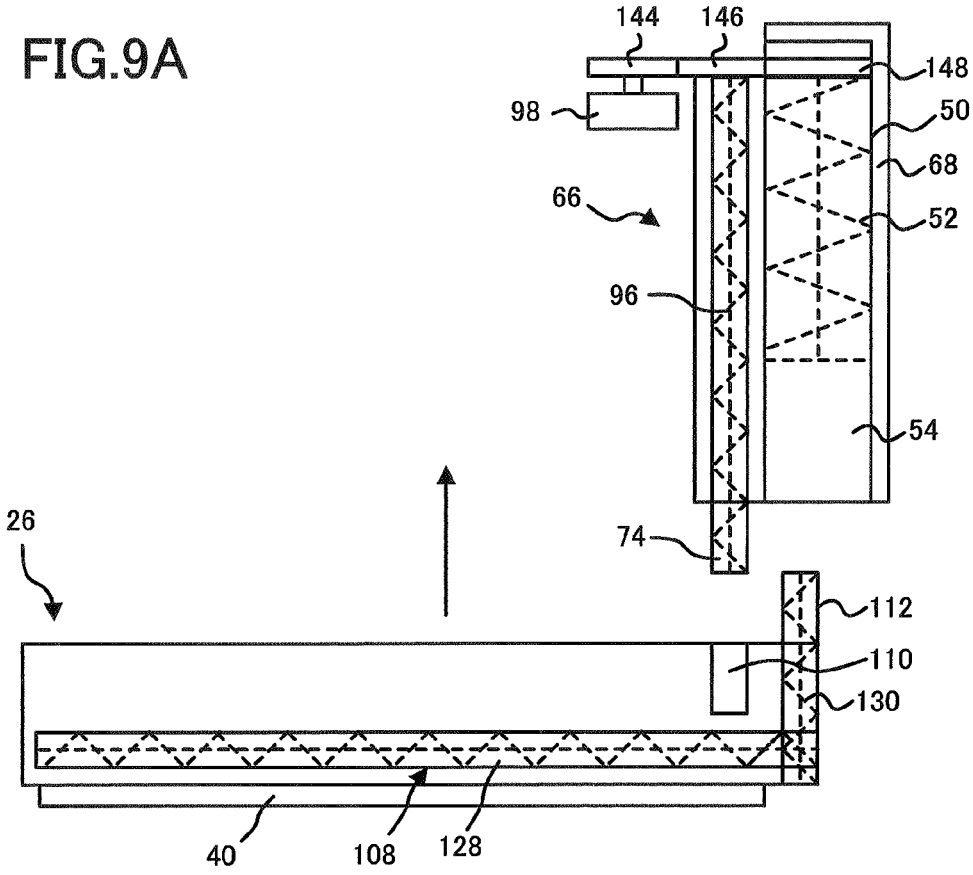
FIGS. 9A and 9B are cross-sectional views showing the relationship among the image holder unit 26, the developing material supply controller 66 and the developing material cartridge 50 of the image forming apparatus 10 according to the first exemplary embodiment of the present invention.
Figure 9B:
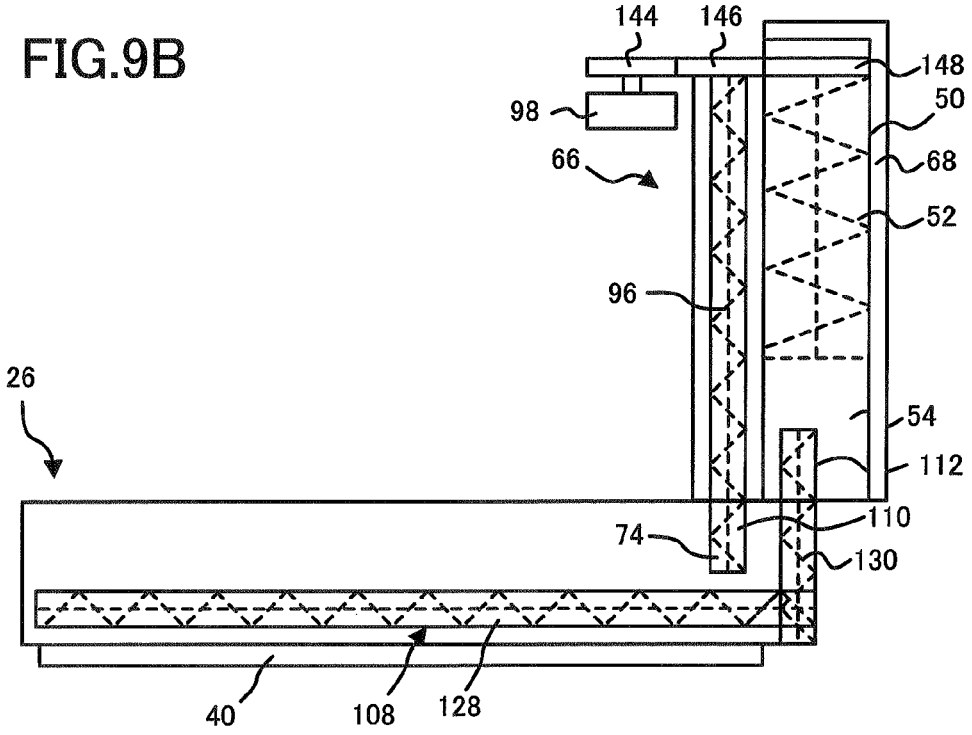

FIGS. 9A and 9B are cross-sectional views showing the relationship among the image holder unit 26, the developing material supply controller 66 and the developing material cartridge 50. FIG. 9A shows a status where the image holder unit 26 and the developing material cartridge 50 are separated from each other. FIG. 9B shows a status where the image holder unit 26 and the developing material cartridge 50 are connected to each other.

In the image holder unit 26, each collected developing material conveyance unit 108 has at least two collected developing material conveyance members. The two collected developing material conveyance members are crossed each other. Further, at least a part of the collected developing material conveyance unit 108 is provided in a direction approximately orthogonal to the developing material cartridge 50.

In the present exemplary embodiment, as shown in FIG. 9A, the collected developing material conveyance unit 108 has two collected developing material conveyance members 128 and 130 approximately crossed each other. The collected developing material conveyance member 128 is provided in a direction approximately orthogonal to the developing material cartridge 50. The image holder unit 26 is attached to the developing material supply controller 66 in a direction as indicated with an arrow in FIG. 9A. As shown in FIG. 9B, the image holder unit 26 and the developing material supply controller 66 are connected with each other such that the first connection portion 74 of the developing material supply controller 66 is inserted into the insertion portion 110 of the image holder unit 26 and the second connection portion 112 of the image holder unit 26 is inserted into the collection orifice 86 of the collected developing material container 54 of the developing material cartridge 50 attached to the developing material supply controller 66.

Note that the developing material supply controller 66 is provided with gears 144 and 146, and the developing material cartridge 50 is provided with a gear 148. The supply developing material conveyance unit 96 of the developing material supply controller 66 is driven with the motor 98 via the gears 144 and 146, and the conveyance member of the developing material cartridge 50 is driven with the motor 98 via the gear 148 in addition to the gears 144 and 146.

Figure 10:
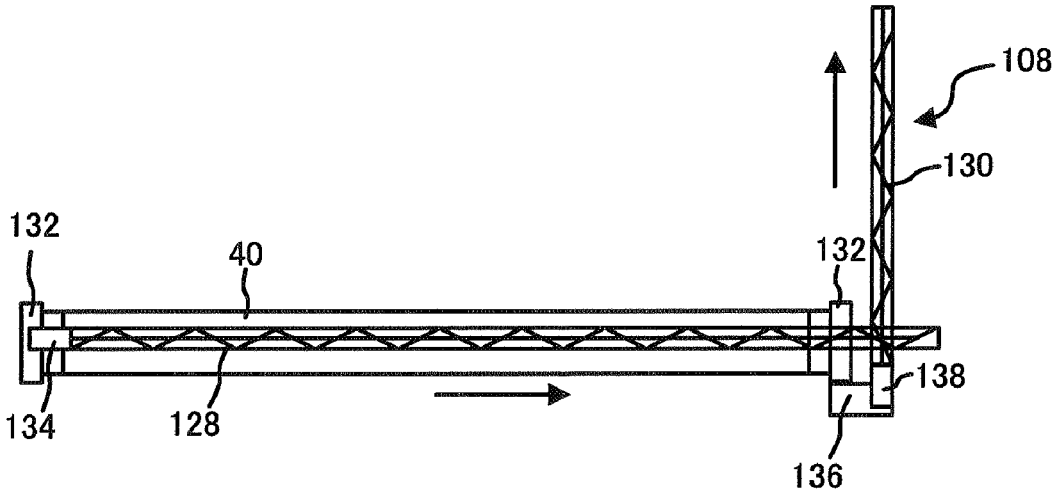
FIG. 10 is a cross-sectional view explaining a conveyance mechanism of a collected developing material conveyance unit 108 of the image forming apparatus 10 according to the first exemplary embodiment of the present invention.

FIG. 10 is a cross-sectional view explaining a conveyance mechanism of the collected developing material conveyance unit 108 of the image forming apparatus 10 according to the exemplary embodiment.

As shown in FIG. 10, a flange 132 is provided at e.g. outer edges of both ends of the image holder 40, and a gear 134 is provided at one end of the collected developing material conveyance member 128. Further, a gear 138 is provided at one end of the collected developing material conveyance member 130. A gear 136 is provided to be engaged with the gear 138 and the flange 132 provided on the developing material cartridge 50 side in the image holder 40.

Accordingly, the gear 134 is driven with the flange 132 provided on the other side than the developing material cartridge 50 side in the image holder 40, thereby the collected developing material conveyance member 128 is rotated. The gear 138 is driven with the flange 132 provided on the developing material cartridge 50 side in the image holder 40 via the gear 136, thereby the collected developing material conveyance member 130 is rotated. Note that an arrow in FIG. 10 indicates a conveyance direction of collected developing material.

Figure 11:
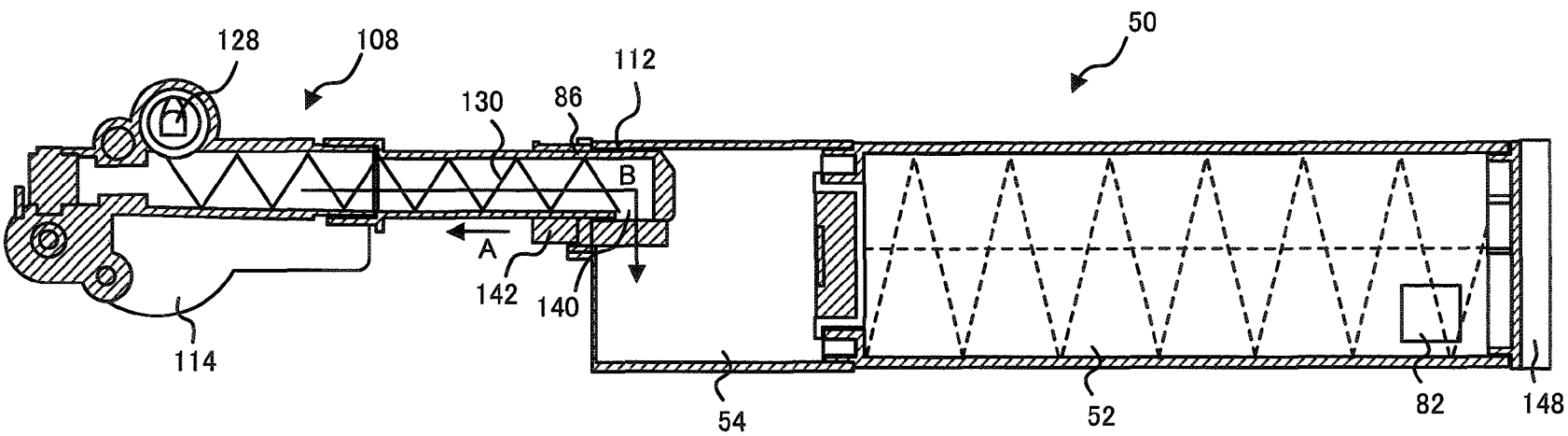
FIG. 11 is a cross-sectional view showing the collected developing material conveyance unit 108 and the developing material cartridge 50 connected with each other.

FIG. 11 is a cross-sectional view showing the collected developing material conveyance unit 108 and the developing material cartridge 50 connected with each other.

As shown in FIG. 11, the second connection portion 112 of the collected developing material conveyance unit 108 is provided with the opening 140 to collect developing material into the collected developing material container 54 of the developing material cartridge 50 and an opening shutter member 142 to open/close the opening 140. When the second connection portion 112 is inserted into the opened collection orifice 86 of the developing material cartridge 50, the opening shutter member 142 is moved in a direction indicated with an arrow A in FIG. 11. Accordingly, the opening 140 is opened. Note that an arrow B in FIG. 11 indicates the collected developing material conveyance direction.

Next, the operation of the image forming apparatus 10 according to the present exemplary embodiment will be described.

When the image holder unit 26 is attached to the image forming apparatus main body 12, the image holder unit 26 is connected to the developing material supply controller 66 of the image forming apparatus main body 12. The first connection portion 74 of the developing material supply controller 66 is inserted into the insertion portion 110 of the image holder unit 26. When the open-close cover 64 of the image forming apparatus 10 is opened and the developing material cartridge 50 is inserted into the developing material cartridge holder 68 of the developing material supply controller 66 and is attached to the image forming apparatus main body 12, the supply orifice 82 and the collection orifice 86 of the developing material cartridge 50 are opened. The second connection portion 112 of the image holder unit 26 is inserted into the opened collection orifice 86 of the developing material cartridge 50. Accordingly, when the developing material cartridge 50 is attached to the developing material supply controller 66, the first connection portion 74 is connected to the supply developing material container 52 of the developing material cartridge 50 via the supply developing material conveyance unit 96 and the opening 92.

In the supply developing material container 52 of the developing material cartridge 50, developing material is conveyed with the conveyance member driven with the motor 98 via the gears 144, 146 and 148 toward the supply orifice 82 of the developing material cartridge 50, and supplied from the supply developing material container 52 via the supply orifice 82 to the developing material supply controller 66. In the developing material supply controller 66, the developing material is supplied via the opening 92 to the supply developing material conveyance unit 96, conveyed with the motor 98 and the supply developing material conveyance unit 96 toward the first connection portion 74, and supplied via the opening 100 to the developing unit 114 of the image holder unit 26. In the developing unit 114, the developing material is conveyed downward with the supply developing material conveyance member 128 along the bottom surface of the conveyance path 116 from the first bottom surface 124 toward the second bottom surface 126.

The developing material supplied as above is used for development of a latent image formed on the image holder 40. Accordingly, a latent image is formed by a light writer 56 on the respective image holder 40 uniformly charged with the charging device 42, and visualized with toner (developing material) by the developing device 44. The toner images formed on the image holders 40 are transferred onto a sheet conveyed with the conveyance belt 60 of the transfer unit 28, and fixed to the sheet by the fixing device 30.

When the developing material remains on the image holder 40, the developing material is removed with the cleaning device 48 from the image holder 40. The removed developing material is conveyed with the collected developing material conveyance member 128 of the collected developing material conveyance unit 108 in the direction of the collected developing material conveyance member 130, conveyed with the collected developing material conveyance member 130 in the direction of the developing material cartridge 50, and collected, via the collection orifice 86 in which the second connection portion 112 is inserted, into the collected developing material container 54 of the developing material cartridge 50.

Next, a second exemplary embodiment of the present invention will be described with reference to the drawings.

The difference between the image forming apparatus 10 according to the second exemplary embodiment and the image forming apparatus 10 according to the first exemplary embodiment is that in the image forming apparatus 10 according to the second exemplary embodiment, the collected developing material conveyance unit 108 has one collected developing material conveyance member 128.

Figure 12A:
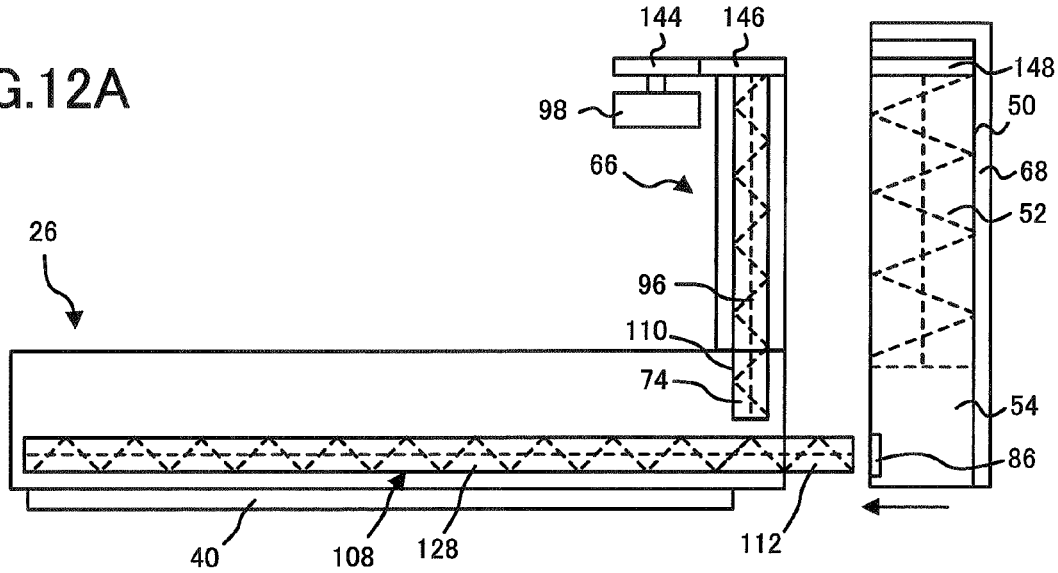
FIGS. 12A and 12B are cross-sectional views explaining the relationship among the image holder unit 26, the developing material supply controller 66 and the developing material cartridge 50 of the image forming apparatus 10 according to a second exemplary embodiment of the present invention.
Figure 12B:
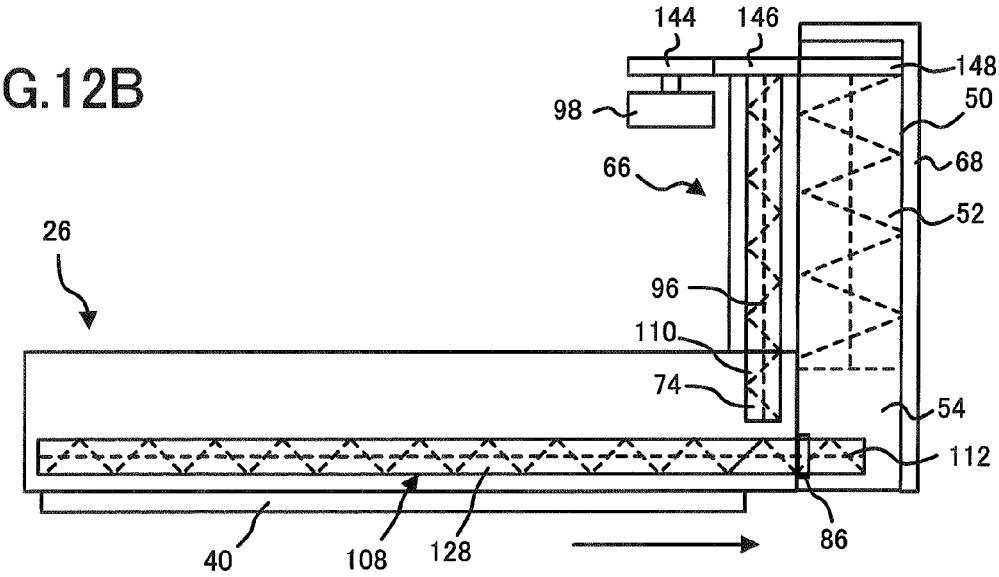

FIGS. 12A and 12B are cross-sectional views explaining the relationship among the image holder unit 26, the developing material supply controller 66 and the developing material cartridge 50 according to the present exemplary embodiment. FIG. 12A shows a status where the image holder unit 26 and the developing material cartridge 50 are separated from each other. FIG. 12B shows a status where the image holder unit 26 and the developing material cartridge 50 are connected to each other. Note that in FIGS. 12A and 12B, constituent elements substantially the same as those shown in FIGS. 9A and 9B have the same reference numerals.

As shown in FIG. 12A, each collected developing material conveyance unit 108 of the image holder unit 26 has one collected developing material conveyance member 128. The collected developing material conveyance member 128 is provided in a direction approximately orthogonal to the developing material cartridge 50. In the developing material cartridge 50, the collection orifice 86 is provided on a wall surface along the lengthwise direction of the developing material cartridge 50. The developing material cartridge 50 is attached to the image holder unit 26 in a direction indicated with an arrow in FIG. 12A. As shown in FIG. 12B, the developing material cartridge 50 is attached to a side surface of the image holder unit 26 such that the second connection portion 112 of the image holder unit 26 is inserted into the collection orifice 86 of the collected developing material container 54 of the developing material cartridge 50.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image holder, a plurality of developing devices, a plurality of developing material cartridges and a plurality of developing material conveyance units;

wherein each of the plurality of developing devices develops a latent image formed on the image holder with developing material and is stacked in a gravitational direction;

each of the plurality of developing material cartridges has a supply developing material container to contain developing material, and is provided in a direction approximately orthogonal to each of the plurality of developing devices and is stacked in a gravitational direction; and each of the plurality of developing material conveyance units has a connection portion connected to the developing device, that conveys the developing material from the supply developing material container to the developing device, at least a part of the connection portion is provided within a heightwise directional width of the developing material cartridge wherein each of the plurality of developing material cartridges further has a collected developing material container that contains developing material collected from the image holder.

2. The image forming apparatus according to claim 1, wherein each of the plurality of the developing material conveyance units is formed so as to rise toward the connection portion.

3. The image forming apparatus according to claim 1, further comprising a collected developing material conveyance unit that conveys the developing material collected from the image holder to the collected developing material container, wherein at least a part of the collected developing material conveyance unit is provided in a direction approximately orthogonal to the developing material cartridge.

4. The image forming apparatus according to claim 3, wherein the collected developing material conveyance unit has at least two collected developing material conveyance members, and the two collected developing material conveyance members are crossed each other.

5. The image forming apparatus according to any one of claims 1-2 and 3-4, wherein each of the plurality of developing devices has a supply developing material conveyance member that conveys developing material, and the supply developing material conveyance member becomes thicker along a developing material conveyance direction.

6. The image forming apparatus according to any one of claims 1-2 and 3-4, wherein each of the plurality of developing devices is provided with a conveyance path to convey developing material, and the conveyance path is provided with a step portion having a bottom surface becoming lower along the developing material conveyance direction.

7. The image forming apparatus according to any one of claims 1-2 and 3-4, wherein each of the plurality of developing devices is provided with a conveyance path to convey developing material, and the conveyance path has a projection portion having a projecting upper surface.

8. An image forming apparatus, comprising:

an image holder, a plurality of developing devices, a plurality of developing material cartridges, a plurality of material conveyance units and a plurality of collected developing material conveyance units;

wherein each of the plurality of developing devices develops a latent image formed on the image holder with developing material and is stacked in a gravitational direction;

each of the plurality of developing material cartridges has a supply developing material container to contain developing material and a collected developing material container that contains developing material collected from the image holder, and is provided in a direction approximately orthogonal to the developing device and is stacked in a gravitational direction;

each of the plurality of material conveyance units has a first connection portion connected to the developing device that conveys the developing material from the supply developing material container to the developing device;

each of the plurality of collected developing material conveyance units has a second connection portion connected to the collected developing material container that conveys the developing material collected from collected developing material container, and at least a part of the first connection portion and the second connection portion are provided within a heightwise directional width of the developing material cartridge.

* * * * *